United States Patent [19]

Pracht

[11] Patent Number: 4,658,678

[45] Date of Patent: Apr. 21, 1987

[54] CORK SCREW FURNISHED WITH A BELL-SHAPED HOUSING

[75] Inventor: Günther Pracht, Solingen, Fed. Rep. of Germany

[73] Assignee: August Reutershan GmbH. & Co. KG., Solingen, Fed. Rep. of Germany

[21] Appl. No.: 785,121

[22] Filed: Oct. 7, 1985

[30] Foreign Application Priority Data

Nov. 28, 1984 [DE] Fed. Rep. of Germany ..... 3443307

[51] Int. Cl.[4] ..... B67B 7/04

[52] U.S. Cl. ..... 81/3.29; 81/3.45

[58] Field of Search ..... 81/3.48, 3.49, 3.45, 81/3.47, 3.56, 3.29, 3.36

[56] References Cited

U.S. PATENT DOCUMENTS

| | | | |
|---|---|---|---|
| 2,522,219 | 9/1950 | Gaeta . | |
| 4,276,789 | 7/1981 | Allen | 81/3.48 |
| 4,570,512 | 2/1986 | Pracht | 81/3.29 |

FOREIGN PATENT DOCUMENTS

| | | | |
|---|---|---|---|
| 931373 | 8/1973 | Canada | 81/3.48 |
| 0056011 | 7/1982 | European Pat. Off. . | |
| 3346414 | 1/1985 | Fed. Rep. of Germany . | |
| 2340899 | 9/1977 | France . | |
| 7701338 | 8/1977 | Netherlands | 81/3.48 |
| 8400994 | 10/1985 | Netherlands . | |

*Primary Examiner*—Frederick R. Schmidt
*Assistant Examiner*—Debra S. Meislin
*Attorney, Agent, or Firm*—John C. Smith, Jr.

[57] ABSTRACT

In order to constructionally simplify a cork screw having a bell-shaped housing with which a cork can be lifted out of the bottle neck without reversing the turning direction of the cork-screw blade, the cork-screw blade projects in a known manner with one of its ends out of the closed end of the bell-shaped housing and is firmly connected to a tommy handle. A telescopic tube is arranged between the bell-shaped housing and the tommy handle and encompasses a section of the cork-screw blade, said telescopic tube being firmly connected with one of its ends to the bell-shaped housing and with its other end to the tommy handle.

11 Claims, 3 Drawing Figures

CORK SCREW FURNISHED WITH A BELL-SHAPED HOUSING

BACKGROUND OF THE INVENTION

This invention relates to a cork screw furnished with a bell-shaped housing and a cork-screw blade such that the cork is able to be lifted out of the neck of a bottle without reversing the turning direction of the cork-screw blade.

From a not previously published patent application a cork screw furnished with a bell-shaped housing is known in which the cork-screw blade is arranged with one of its ends at the closed end of the bell-shaped housing and the bell-shaped housing is so mounted on a sleeve-like body that it is axially shiftable and rotatable thereon. The sleeve-like body is provided at its outer circumference with two circular shoulders arranged at a a distance from one another and the bell-shaped housing is provided at the lowermost portion of its inner circumference with a circular shoulder which cooperates with the shoulders of the sleeve-like body in order to limit the shifting movements of the bell-shaped housing. The known cork screw has a tommy handle which is integrally formed with the bell-shaped housing and consists, with the exception of the cork-screw blade, of plastic material in order to be able to produce the cork screw as economically as possible. The economic production from plastic material, however, is adversely affected by the fact that the bell-shaped housing cannot be made in one piece not only because of the circular shoulder arranged at its inner circumference but also because of the limitation of its shifting movements on the sleeve-like body. The bell-shaped housing rather consists of two longitudinal halves which after assembly must be welded together on the sleeve-like body. This is complicated and time consuming. Furthermore, by the arrangement of the sleeve-like body the consumption of the material required for producing the cork screw is enormous. This, however, is of great importance because a cork screw is a mass product.

SUMMARY OF THE INVENTION

It is, therefore, an object of the present invention to provide a cork screw furnished with a bell-shaped housing, which avoids the above-mentioned disadvantages.

Another object of the invention is to simplify a cork screw of the kind described above as regards its construction so that it can be produced at lower expenses than before.

To attain these objects the present invention provides a cork screw furnished with a bell-shaped housing and a cork-screw blade such that the cork is able to be lifted out of a bottle neck without reversing the turning direction of the cork-screw blade, wherein one end of the corkscrew blade projects in a known manner out of the closed end of the bell-shaped housing and is here firmly connected to a tommy handle, and a telescopic tube encompasses the cork-screw blade and is arranged between the bell-shaped housing and the tommy handle, said telescopic tube comprising a number of individual tubes and being firmly connected with one of its ends to the bell-shaped housing and with its other end to the tommy handle.

In the cork screw proposed by the present invention the sleeve-like body required up to now has been substituted by the telescopic tube, the individual tubes of which during turning the tommy handle for the purpose of driving the cork-screw blade into the cork of the bottle to be uncorked and exerting a slight pressure on the tommy handle are pushed one after the other into one another until the tommy handle reaches a fixed point so that the cork-screw blade cannot be driven further into the cork. When the tommy handle is turned further, the cork is lifted out of the neck of the bottle to be uncorked in the known manner without reversing the turning direction of the cork-screw blade. Due to the omission of the sleeve-like body the bell-shaped housing may be produced in one piece and also the assemblage of the individual parts of the cork screw is substantially simplified. Furthermore, by the omission of the sleeve-like body the required amount of plastic material for producing the plastic parts of the cork screw is substantially reduced. This has a positive effect as regards the costs in that for the production of the plastic parts a plastic material must be used which gives the plastic parts the required stability. Such plastic material, however, is relatively expensive as regards the prime cost. The telescopic tube of metal can in contrast thereto be produced economically and at low costs.

An advantageous development of the invention is one in which a prestressed helical compression spring is arranged in the telescopic tube which surrounds the corkscrew blade and acts upon the tommy handle.

By means of the helical compression spring the tommy handle and the cork-screw blade are held in the starting position and thus the telescopic tube in its extended position when the cork screw is not in use.

A further advantageous development of the invention is one in which a circular hub is fixedly arranged both peripherally at the closed end of the bell-shaped housing and at the bottom side of the tommy handle, the telescopic tube being guided on said hubs and firmly connected thereto.

Thereby, in an advantageous manner, a simple connection of the telescopic tube with the bell-shaped housing and the tommy handle is achieved. Since the bell-shaped housing and the tommy handle are preferably made of plastic material, the hubs are integrally formed with the bell-shpaed housing and the tommy handle.

In another advantageous development of the invention a hollow cylindrical body is centrally fixed to the hub provided at the closed end of the bell-shaped housing, said hollow cylindrical body being shorter, as regards its length, than the length of that tube of the telescopic tube which is firmly connected to the closed end of the bell-shaped housing.

The hollow cylindrical body is preferably integrally formed with the hub at the closed end of the bell-shaped housing during the process of producing the bell-shaped housing from plastic material and serves, on the one hand, the purpose of guiding the cork-screw blade so that a central driving in of the cork-screw blade in the cork is ensured. On the other hand, the hollow cylindrical body forms an abutment against which the hub of the tommy handle rests when the cork-screw blade has been driven into the cork and by which the cork-screw blade is supported in order to lift the cork out of the bottle neck.

BRIEF DESCRIPTION OF THE DRAWING

An embodiment of the invention will now be described by way of example and with reference to the accompanying drawing in which.

DESCRIPTION OF THE PREFERRED EMBODIMENT

Figure 1:
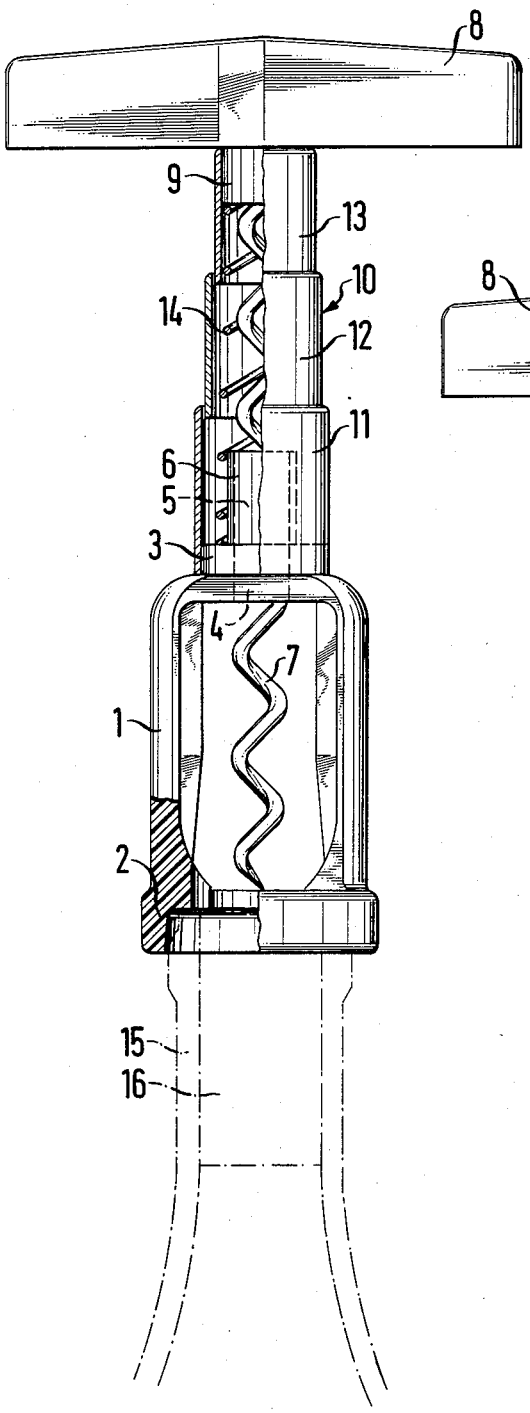
FIG. 1 is a side elevational view, partly in section, of a cork screw according to the present invention, the cork-screw blade being shown in its starting position.
Figure 3:
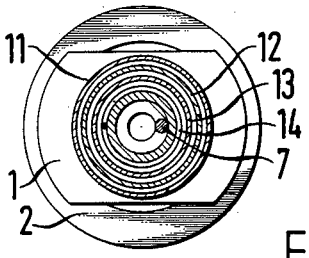
FIG. 3 is a cross-sectional view on the line III—III of FIG. 2.
Figure 2:
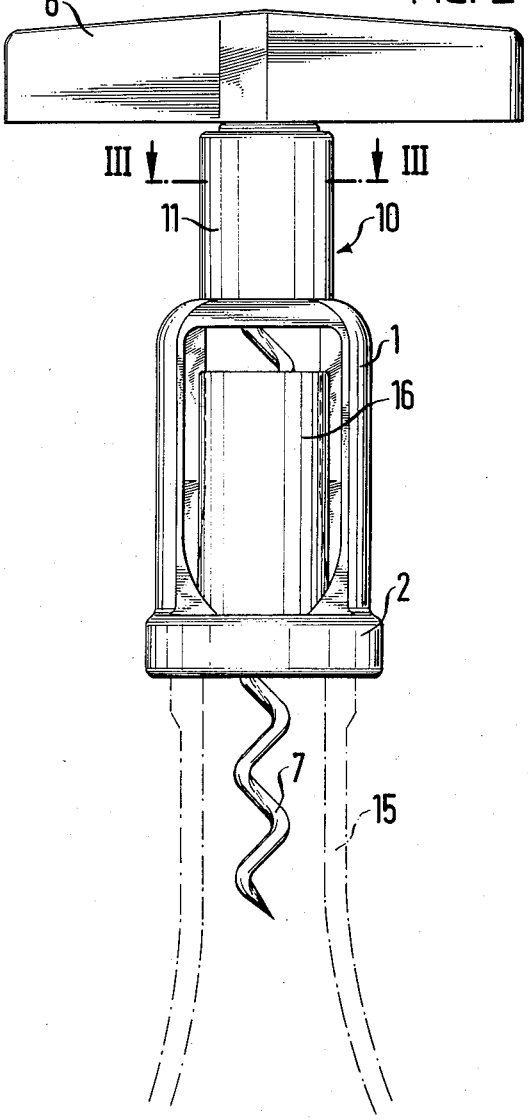
FIG. 2 is a side elevational view of the cork screw similar to that shown in FIG. 1 but with the cork being lifted out of the bottle to be uncorked.

FIGS. 1 and 2 show a cork screw having a bell-shaped housing 1 which is made of plastic material and has at its lower end a collar 2 formed integrally therewith and a circular hub 3 formed integrally with the periphery of the closed end of the bell-shaped housing 1. The hub 3 and the closed end of the bell-shaped housing 1 have axially aligned passage openings 4 and 5. Furthermore, a hollow cylindrical body 6 is formed integrally with the hub 3 so as to extend concentrically therefrom in direction toward the closed end of the housing 1. The reference numeral 7 designates a cork-screw blade which is formed helix-shaped over its entire length and the reference numeral 8 designates a tommy handle made of plastic material. The tommy handle 8 has at its bottom side a circular hub 9 formed integrally therewith. The cork-screw blade 7 passes with one of its ends through the passage openings 4 and 5 and the hollow cylindrical body 6 with clearance and is firmly anchored in the hub 9. In the starting position, the cork-screw blade 7 extends with its free end up to about the lower end of the bellshaped housing 1. The reference numeral 10 designates generally a telescopic tube which is composed of three tubes 11, 12 and 13. The tube 11 is fixedly arranged with one of its ends on the hub 3 and the tube 13 is fixedly arranged with one of its ends on the hub 9. The extended telescopic tube 10 surrounds that portion of the cork-screw blade 7 which is located between the bell-shaped housing 1 and the tommy handle 8. A prestressed helical compression spring 14 which encompasses the cork-screw blade 7 is arranged in the telescopic tube 10 and rests with its one end against the hub 3 and with its other end against the hub 9 and is guided on the hollow cylindrical body 6. The reference numeral 15 designates the neck of a bottle which is shown by dash-and-dot lines and reference numeral 16 designates the cork of the bottle.

The mode of operation of the cork screw is as follows:

The collar 2 of the bell-shaped housing 1 of the cork screw is firmly put on the neck 15 of the bottle to be uncorked, the cork-screw blade 7 penetrating the cork 16 with its tip. The tommy handle 8 is then turned clockwise under a slight pressure with one hand of the person using the cork screw. In doing so, the tubes 12 and 13 are pushed into the tube 11 of the telescopic tube 10 so that the helical compression spring 14 is further biased and the cork-screw blade 7 is driven into the cork 16 until the free end face of the hub 9 of the tommy handle 8 engages the free end face of the hollow cylindrical body 6. When the tommy handle 8 is further turned clockwise, the cork 16 is lifted out of the neck 15 of the bottle and drawn into the bell-shaped housing 1. After the cork 16 has been lifted out of the neck 15 of the bottle, the cork-screw blade 7 is driven out of the cork 16. For this purpose, the tommy handle 8 is turned counterclockwise and moved back into its starting position with the aid of the helical compression spring 14, the telescopic tube 10 thereby being extended again. When the starting position has been reached, the tommy handle 8 is turned so long until the cork-screw blade 7 is fully driven out of the cork 16 and the cork 16 then falls out of the bell-shaped housing 1.

The invention may be embodied in other specific forms without departing from the spirit or essential characteristics thereof. The embodiment is therefore to be considered in all respects as illustrative and not restrictive.

What is claimed is:

1. A cork screw furnished with a bell-shaped housing and a cork-screw blade such that the cork is able to be lifted out of a bottle neck without reversing the turning direction of the cork-screw blade, wherein (a) one end of the cork-screw blade projects in a known manner out of one end of the bell-shaped housing and is here firmly connected to a tommy handle, and (b) a telescopic tube encompasses the cork-screw blade and is arranged between the bell-shaped housing and the tommy handle, said telescopic tube comprising a number of individual tubes and being firmly connected with one of its ends to the bell-shaped housing and with its other end to the tommy handle.

2. A cork screw as claimed in claim 1, wherein a prestressed helical compression spring is arranged in the telescopic tube, said spring encompassing the cork-screw blade and acting upon the tommy handle.

3. A cork screw as claimed in claim 1, wherein a circular hub is fixedly arranged both peripherally at the one end of the bell-shaped housing and at the bottom side of the tommy handle, the telescopic tube being mounted to said hubs and firmly connected thereto.

4. A cork screw as claimed in claim 1, wherein a hollow cylindrical body is centrally fixed to the hub provided at the one end of the bell-shaped housing, said hollow cylindrical body being shorter, as regards its length, then the length of that tube of the telescopic tube which is firmly connected to the one end of the bell-shaped housing.

5. A cork screw as claimed in claim 1 wherein said number of individual tubes of said telescopic tube are axially slidable with respect to each other.

6. Apparatus including rotating means for extracting a cork from a bottle without reversing the direction of rotation, said apparatus comprising:

a. a bell-shaped housing having an open end for engaging a bottle neck and an opposite end having an axial bore;

b. telescopic tube means projecting from said opposite end of said bell-shaped housing and comprising a plurality of tubes which are axially slidable with respect to each other, the tube at one end of said telescopic tube means being connected to said opposite end of said bell-shaped housing about said bore therein; and c. an elongated helical cork-screw blade having a handle secured to one end thereof, said helical cork-screw blade extending through said telescopic tube means, through said bore in said opposite end of said bell-shaped housing and through said bell-shaped housing, and said handle being secured to the tube at the end of said telescopic tube means opposite said one end thereof;

d. whereby, to extract a cork from a bottle neck, said open end of said bell-shaped housing is engaged with the bottle neck and, when said handle is rotated and said helical cork-screw blade passes through the cork, said handle moves axially towards said bell-shaped housing and said plurality of tubes are caused to slidably telescope and, after removal of said cork, said bell-shaped housing and said handle may be moved away from each other and said telescopic tube means expanded.

7. Apparatus according to claim 6, further comprising compression spring means biasing said handle and bell-shaped housing away from each other such that said spring means, compressed during rotation of said handle and helical cork-screw blade to extract a cork from a bottle neck and telescoping of said plurality of tubes of said telescopic tube means, causes said handle and bell-shaped housing to move away from each other and said telescopic tube means to expand following removal of the cork from the bottle neck.

8. Apparatus according to claim 7 wherein said compression spring means comprises a helical spring.

9. Apparatus according to claim 8 wherein said helical spring is located in said telescopic tube means and about said cork-screw blade and extends between said handle and said bell-shaped housing.

10. Apparatus according to claim 9 further comprising a hub on said bell-shaped housing and a hub on said handle, the respective tubes at the opposite ends of said telescopic tube means being mounted on the respective of said hubs.

11. Apparatus according to claim 10 further comprising an elongated hollow body mounted on said hub on said bell-shaped housing, said elongated hollow body being shorter than said tube at said one end of said telescopic tube means.

* * * * *